US007331292B1

(12) United States Patent
Kim et al.

(10) Patent No.: US 7,331,292 B1
(45) Date of Patent: Feb. 19, 2008

(54) VENTING SYSTEM FOR EXPLOSIVE WARHEADS

(75) Inventors: Steven S. Kim, Crofton, MD (US); Eric Hawley, Prince Frederick, MD (US); Joni Johnson, La Plata, MD (US); Matt Nolder, Indian Head, MD (US); John Luense, Accokeek, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 177 days.

(21) Appl. No.: 10/807,581

(22) Filed: Mar. 23, 2004

(51) Int. Cl.
*F41A 9/00* (2006.01)

(52) U.S. Cl. ..... 102/481; 102/473

(58) Field of Classification Search ..... 102/481, 102/473, 202.7, 200
See application file for complete search history.

(56) References Cited

U.S. PATENT DOCUMENTS 4,557,198 A * 12/1985 Hickey ..... 102/481
4,956,971 A * 9/1990 Smith ..... 60/245
5,036,658 A 8/1991 Tate ..... 60/253
5,044,154 A * 9/1991 English et al. ..... 60/223
5,155,298 A 10/1992 Koontz ..... 102/481
H1144 H 3/1993 Cherry et al. ..... 60/39.1
5,311,820 A 5/1994 Ellingsen ..... 102/481
5,394,803 A 3/1995 Mort ..... 102/377
5,735,114 A 4/1998 Ellingsen ..... 60/39.1
6,338,242 B1 * 1/2002 Kim et al. ..... 60/204
6,752,085 B2 * 6/2004 Roach ..... 102/481
7,025,000 B1 * 4/2006 Wong et al. ..... 102/481

FOREIGN PATENT DOCUMENTS

GB 2 038 918 A 7/1980

* cited by examiner

*Primary Examiner*—Michelle Clement
(74) *Attorney, Agent, or Firm*—Fredric J. Zimmerman

(57) ABSTRACT

An ordnance venting system has one or more adapters that separate the warhead section from other sections of a rocket, or submunition compartments within the warhead itself. The adapters structurally fail at given temperatures and pressures to reduce the danger of explosion from heat induced over-pressurization. By dividing the sections of the rocket with the adapters, the separate sections of the rocket become physically separated by the structural failure of the adapters.

20 Claims, 1 Drawing Sheet

VENTING SYSTEM FOR EXPLOSIVE WARHEADS

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention relates an ordnance venting system to reduce the danger of explosion for heat induced over-pressurization. The ordnance venting system has one or more adapters that melt prior to rocket warhead cook-off to prevent over-pressurization off the rocket warhead. The term rocket in this patent refers to both unguided rockets and guided rockets, e.g., missiles.

2. Brief Description of the Related Art

One type of rocket weapon systems isolates the warhead from the other parts of the rocket during handling, shipment and storage, while allowing the warhead to be attached to the rocket in the field or on board a warship prior to use. Such rocket weapons systems include the 2.75-inch diameter MK 66 Rocket system having the M229 Warhead, which is used by the United States armed services. The M229 Warhead casing is metallic and, when assembled onto the MK 66 Rocket, a fuze is threaded onto the forward end of the warhead. The current M229 Warhead is a high-explosive warhead that does not contain a venting system to mitigate the warhead's reaction to external heat stimuli such as fuel fires, combat damage or other adverse conditions.

There is a need in the art of rocket venting devices for improvements in response to insensitive munition (IM) threats, such as fast cook-off, slow cook-off, bullet impact, fragment impact and sympathetic detonation, particularly for munitions that are designed for sectionally attaching the warhead to the rocket, either at an assembly site or in an operational setting prior to use. The present invention addresses this and other needs.

SUMMARY OF THE INVENTION

The present invention includes an ordnance venting system to reduce the danger of explosion from heat induced over-pressurization in rockets comprising a first rocket section comprising a warhead having at least a first connectable end and an adapter that melts at high temperatures having a first mating surface and a second mating surface, the first mating surface of the adapter effective to rigidly connect to the first connectable end of the first rocket section and the second mating surface of the adapter effective to rigidly connect with a connectable end of a second rocket section, wherein the adapter binds the first rocket section and second rocket section. The rocket warhead section may include a second connectable end for connecting to a second adapter on the opposite side of the warhead section from the original adapter.

The present invention also includes a method of venting a rocket warhead comprising the steps of providing an ordnance venting system to reduce the danger of explosion from heat induced over-pressurization of the rocket warhead comprising a first rocket section comprising a warhead having at least a first connectable end and an adapter that melts at high temperatures having a first mating surface and a second mating surface, the first mating surface of the adapter effective to rigidly connect to the first connectable end of the first rocket section and the second mating surface of the adapter effective to rigidly connect with a connectable end of a second rocket section, wherein the adapter binds the first rocket section and second rocket section and melting the adapter prior to ordnance cook-off, wherein pressure within the rocket warhead causes the adapter to fail, thereby releasing pressure from within the rocket warhead.

The present invention further includes a vented rocket warhead product produced from the method comprising the steps of providing an ordnance venting system to reduce the danger of explosion from heat induced over-pressurization of the rocket warhead comprising a first rocket section comprising a warhead having at least a first connectable end and an adapter that melts at high temperatures having a first mating surface and a second mating surface, the first mating surface of the adapter effective to rigidly connect to the first connectable end of the first rocket section and the second mating surface of the adapter effective to rigidly connect with a connectable end of a second rocket section, wherein the adapter binds the first rocket section and second rocket section and melting the adapter prior to ordnance cook-off, wherein pressure within the rocket warhead causes the adapter to fail, thereby releasing pressure from within the rocket warhead.

The present invention is particularly useful on the MK 66 Rocket.

DETAILED DESCRIPTION OF THE PREFERRED EMBODIMENT

The present invention includes a one or more warhead adapters for a rocket that prevents an explosive reaction and over-pressurization within the warhead of the rocket. With increased heat, the explosives within the warhead cause increased pressurization within the rocket. With the melting of the warhead adapter from this increased heat, the warhead is vented prior to cook-off, releasing the built-up pressure through a low explosive event, i.e., an explosive release not caused by detonation. This venting improves Insensitive Munitions (IM) performance of the rocket warhead by providing a cook-off pressure release mechanism which increases safety to property and personnel by mitigating the rocket warhead's reaction to IM stimuli. Although the safety to personnel and property of the MK 66 Rocket is improved, the ballistic performance of the rocket does not diminish. The present invention may be incorporated into any suitable rocket, such as the 2.75-inch diameter MK 66 Rocket system.

Figure 1:
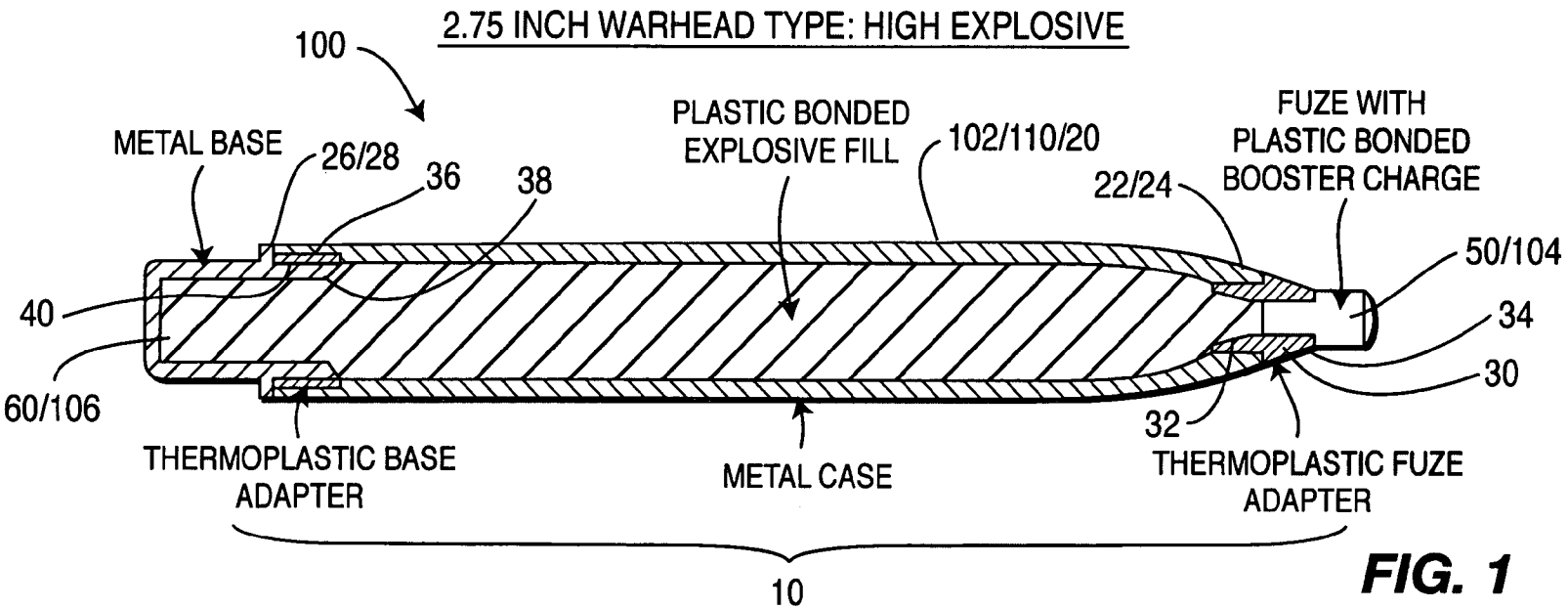
FIG. 1 illustrates a single warhead compartment rocket of the present invention; and, FIG. 2 illustrates an expulsion charged warhead of the present invention.

As seen in FIG. 1, a rocket 100 that incorporates the ordnance venting system 10 of the present invention is shown. The rocket 100 has a warhead 102, composed of a single warhead compartment 110, that is between a fuze section 104 and base section 106 of the rocket 100. The ordnance venting system 10 of the present invention includes a first rocket section 20, being the warhead 102, with the first rocket section 20 having at least a first connectable end 22 located lengthwise at the front of the first rocket section 20. The first connectable end 22 includes at least a first attaching means 24, such as a mating configuration, that allows placement of a first adapter 30 thereto. The first adapter 30 includes a first mating surface 32 that rigidly connects to the first attaching means 24 of the first connectable end 22 of the warhead 102. The first adapter 30 further includes a second mating surface 34 that rigidly connects to a second rocket section 50, which is preferably the fuze section 104 of the rocket 100. The first adapter 30 binds the warhead 102 and the fuze section 104 together, acting as a joint therebetween and functioning as a structural holding member.

The ordnance venting system 10 reduces the danger of explosion from heat induced over-pressurization by melting the first adapter 30 during cook-off, which structurally separates, allowing the sections of the rocket 100 that were being held together by the adapter 30 to become distant from each other while venting the explosive gases of the warhead 102.

Additionally, the first rocket section 20 may include a second connectable end 26 opposite the first connectable end 22 on the first rocket section 20. The second connectable end 26 includes a second attaching means 28, which may be similar or different that the first attaching means 24, that allows placement of a second adapter 40 thereto. The rocket 100 may include only the first adapter 30, only the second adapter 40, or both the first 30 and second 40 adapters. Preferably, the type of connecting means of both the first attaching means 24 and secon attaching means 28 are the same. The second adapter 40 includes a first mating surface 36 that rigidly connects to the second attaching means 28 of the second connectable end 26 of the warhead 102. The second adapter 40 further includes a second mating surface 38 that rigidly connects to a third rocket section 50, which is preferably the base section 106 of the rocket 100.

The first adapter 30, and second adapter 40 when present, are attached to the warhead 102 by any suitable connecting means that reliably attaches the sections of the rocket 100 together. Preferably this connecting means comprises threads that allow the warhead 102 of the rocket 100 to be attached to the other sections of the rocket 100 using the first 30 and second 40 adapters as joint members between the first rocket section 20 and the second 50 and/or third 60 rocket sections. The first adapter 30 attaches to the warhead 102 which is then attached to the fuze section 104. Additionally, the second adapter 40 attaches to the warhead 102 which is then attached to the base section 106 to ready the rocket for launch.

The first adapter 30 and warhead 102 are joined using the first attaching means 24 that rigidly positions the first adapter 30 and warhead 102 relative to each other. The attaching means 24 may include, for example, any appropriate attachment, such as a threading, locking, or screw mechanism, e.g., recessed areas on the adapter 30 that intermesh with warhead threads, or other like means, with proper attachment determinable by those skilled in the art in light of the disclosure herein. Likewise, the second attaching means 28, the first mating surface 36, and the second mating 38 surface are configured in a manner similar to that described for the first attaching means 24, with the first attaching means 24, second attaching means 28, the first mating surface 36, and the second mating surface 38 individually the same or different for a given rocket. Preferably, the first attaching means 24, second attaching means 28, the first mating surface 36, and the second mating surface 38 use the same attachment. A high temperature adhesive, such as that available from Loctite Corporation sold under the tradename Durabond E-20HP, or other chemical bonding may optionally be used to secure the first 30 and second 40 adapters to the second and third sections of the rocket 100.

The first 30 and second 40 adapters melt at high temperatures, i.e., temperatures above ambient that normally occur only during critical conditions of the rocket 100 such as cook-off. This includes melting temperatures of from about 150° F. or greater, more preferably from about 225° F. to about 350° F., still more preferably from about 250° F. to about 350° F., and most preferably from about 275° F. to about 300° F., and structural failure of the adapters 30 and 40 at pressures of from about 5000 psi or greater. The melt temperature is effectively below the warhead explosive auto-ignition temperature, for example 370° F. As the pressure within the adapters 30 and 40 increase, the adapters 30 and 40 may becomes increasingly displaced, and possible ejected, from connecting the warhead 102 with the second and third rocket sections. Displacement or ejection pressures preferably comprise a pressure of from about 5% to about 15% of the maximum expected operating pressure of the ordnance device, with the most preferred displacement or ejection pressure being approximately 5% of the maximum expected operating pressure of the ordnance device. Once the adapters 30 and 40 are melted and the pressure becomes released from the warhead 102, the resulting vented warhead 102 poses a significantly reduced threat to personnel and property with a reduced danger of explosion from heat induced over-pressurization.

The adapters 30 and 40 preferably comprise a type of thermoplastic material, such as polycarbonate. Suitable compositions include, for example, polycarbonate filled with glass, preferably in an amount of from about 20 percent or more, more preferably from about 30 percent to about 40 percent, glass filled polycarbonate for proper melting, with the proper composition of the thermoplastic composition determinable by those skilled in the art in light of the disclosure herein. The glass preferably comprises from about 30 weight percent or more of the polycarbonate, in amounts such as from about 35 weight percent to about 75 weight percent, from about 30 weight percent to about 40 weight percent. The glass filled polycarbonate provides strength and temperature characteristics suitable for rocket use. Polycarbonate materials are commercially available from General Electric under the tradename Lexan. Other suitable materials for the adapters 30 and 40 include a nylon material, such as nylon 6/6, manufactured by Amco Plastic Materials. Additionally, the adapter may comprise a Teflon® material, such as that manufactured by DuPont of Wilmington, Del. The thermoplastic adapters 30 and 40 are preferably formed from injection molding to maximize the strength of the thermoplastic adapters 30 and 40. Injection molding of the thermoplastic warhead adapter also allows manufacturing with low cost and mass production.

Figure 2:
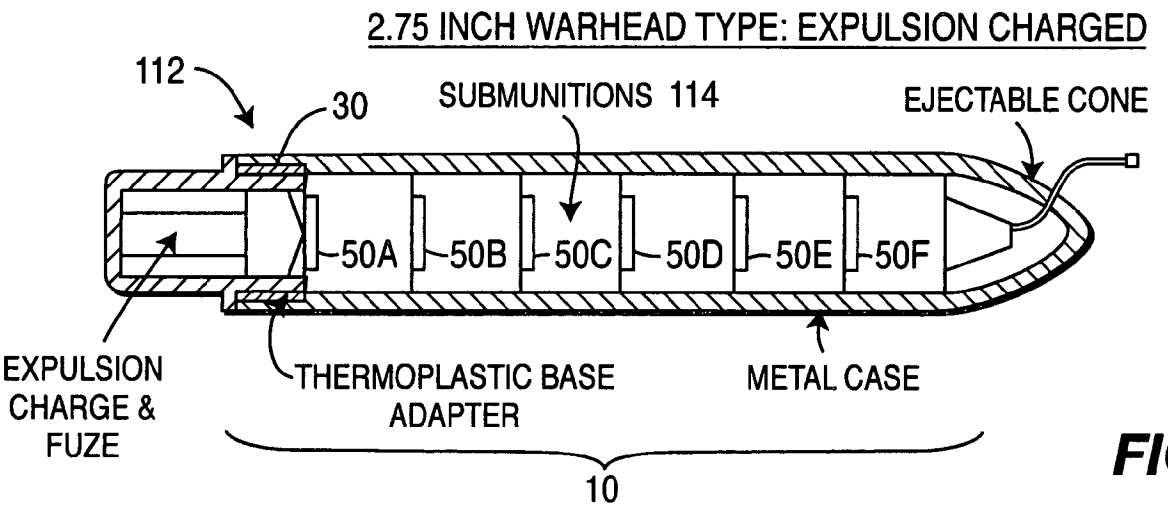

In a second preferred embodiment, the ordnance venting system 10 is incorporated into the expulsion charged warhead 112 between one or more of the individual submunitions 114 of the warhead 102. FIG. 2 illustrates the second embodiment of the rocket 100 ordnance venting system 10 of the present invention of an expulsion charged warhead 112, having multiple submunitions 114 within the warhead 102. In contrast to the single warhead compartment 110 shown in the rocket of FIG. 1 that retains the total amount of warhead explosive as fill with that single compartment, the expulsion charged warhead compartment, shown in FIG. 2, has a plurality of compartments, each of which contains an explosive material. The adapter is placed on the aft end of the warhead 112, with addition adapter 50A-50F placed between some or all of the individual submunition compartments. The multitude of adapters 30 and 50A-50F immediately vent a cook-off problem while minimizing the explosive potential of the building heat and pressure in the warhead 112.

Referring to FIGS. 1 and 2, the warhead adapters 30, 40 and 50A-50F possess a melting temperature sufficiently below the cook-off temperature of the explosive within the warhead to cause the adapters 30, 40 and 50A-50F to significantly deteriorate and weaken where the adapters 30, 40 and 50A-50F to structurally fail prior to cook-off and release explosive gases the warhead 102/112. The deteriorated adapters 30, 40 and 50A-50F create a venting area (vent opening) in the adapters 30, 40 and 50A-50F through which the explosive gases flow. Additionally, the warhead 102 becomes pushed away from the second and third rocket sections by the failure of the melting adapters. The ordnance venting system 10 reduces the danger of explosion from heat induced over-pressurization to the rocket by separating the warhead section 102 from other parts of the rocket 100 prior to cook-off.

Preferably the ordnance venting system 10 is used on the 2.75-inch diameter MK 66 Rocket system. Within the MK 66 Rocket, the adapters 30 and 40 comprises a diameter of approximately equal to that of the rocket warhead, which is approximately 2.7 inches, with a preferred width of from about 1 inch to about 3 inches, and a depth of from about 0.25 inches to about 0.5 inches. The preferred melt temperature of the warhead adapters 30 and 40 ranges from about 250° F. to about 300° F.

In operation, the sections of the rocket are shipped to operational areas in separate pieces to ensure safe transport. Once operationally needed, the warhead section is attached to the adapters 30 and 40, with the fuze and base plate attached onto the adapters 30 and 40, respectively. The addition of the adapters 30 and 40 of the ordnance venting system 10, as previously described, allow venting of the warhead 102/112 after exposure of the ordnance venting system 10 to a heated environment having sufficient temperature elevation to melt the first adapter 30 and second adapter 40. With the melting of the adapters 30 and 40, at a predetermined temperature, the building pressure within the warhead 102/112, relative to the amount of melting that has occurred, ruptures the adapters 30 and 40 and structurally separates the sections of the rocket 100 during failure of the adapters 30 and 40 to maintain their structural integrity. The adapters 30 and 40 fail, causing the warhead 102 to be "blown" away, and preferably blown clear, of the fuze 104 and base 106 sections of the rocket 100. Additionally the failed adapter 30 and 40 provide an open conduit for the expanding gases of the warhead 102 during cook-off, allowing the warhead 102 to vent and release the pressure from within the rocket 100 which reduces the danger of explosion from heat induced over-pressurization.

EXAMPLE (PROPHETIC)

A MK 66 Rocket, with the sections disassembled, is transported to a warship for assembly and use. The rocket is assembled by attaching an adapter onto the front of the rocket warhead by a threaded connection and attaching a second adapter onto the rear of the rocket warhead section by using a second threaded connection. On front of the adapter attached on the front of the rocket warhead section, a fuze is threaded. Onto the rear of the adapter attached on the rear of the warhead a base plate is threaded. The two adapters are constructed of a thermoplastic material to melt at 325° C., and to fail at an internal pressure of 5000 psi at that temperature.

In storage on the ship, the compartment where the assembled rocket is kept becomes damaged, rendering the fire suppression systems inoperative while initiating a fire therein. The assembled rocket becomes exposed to the fire, causing the warhead to increase to a temperature of 325° C., while developing an internal pressure of 5000 psi from the degrading explosive material in the warhead. At this temperature and pressure, the adapters fail, releasing the expanding gases from inside of the rocket. The failing adapters split from the force of the rupture and the distance between the fuze and warhead is increased with a venting space therebetween.

The foregoing summary, description, examples and drawings of the invention are not intended to be limiting, but are only exemplary of the inventive features which are defined in the claims.

What is claimed is:

1. An ordnance venting system to reduce the danger of explosion from heat induced over-pressurization in rocket warheads, comprising:

a first rocket section comprising a rocket warhead section having at least a first connectable end; and, an adapter for melting at high temperatures comprising a first mating surface and a second mating surface, the first mating surface of the adapter effective to rigidly connect to the first connectable end of the rocket warhead section and the second mating surface of the adapter effective to rigidly connect with a connectable end of a second rocket section comprising a fuze section, wherein the adapter binds the first rocket section and the fuze rocket section, wherein a portion of the second mating surface extends beyond the first connectable end in contact with the rocket fuze section, and wherein the first mating surface and the second mating surface are non-continuous surfaces each in a different plane.

2. The ordnance venting system of claim 1, wherein the rocket warhead section comprises a single compartment explosive fill.

3. The ordnance venting system of claim 1, wherein the rocket warhead section comprises a multiple submunitions.

4. The ordnance venting system of claim 1, further comprising a second adapter, wherein the rocket warhead section comprises a second connectable end, the second adapter effective to connect, rigidly, to the second connectable end of the rocket warhead section.

5. The ordnance venting system of claim 1, wherein the adapter is comprised of a thermoplastic material.

6. The ordnance venting system of claim 1, wherein the adapter is comprised of polycarbonate.

7. The ordnance venting system of claim 1, wherein the adapter is comprised of a polycarbonate filled with glass in an amount from at least about 30 weight percent.

8. The ordnance venting system of claim 7, wherein the adapter is comprised of a polycarbonate filled with glass in an amount ranging from about 30 weight percent to about 40 weight percent.

9. The ordnance venting system of claim 1, wherein the adapter is comprised of a nylon material.

10. The ordnance venting system of claim 1, wherein the adapter is comprised of a tetrafluoroethylene material.

11. A rocket comprising the ordnance venting system of claim 1.

12. The rocket of claim 11, wherein the rocket warhead is selected from one of an unguided rocket warhead and a guided rocket warhead.

13. The ordnance venting system of claim 1, wherein the adapter melts at a temperature from at least about 350° F.

14. The ordnance venting system of claim 1, wherein the adapter structurally fails at a pressure from at least about 5000 psi.

15. The ordnance venting system of claim 1, wherein the first mating surface comprises a portion substantially perpendicular to the first connectable end.

16. The ordnance venting system of claim 1, wherein the adapter comprises a an external portion in relation to the first mating surface.

17. The ordnance venting system of claim 1, wherein the first mating surface is a substantially L-shaped first mating surface.

18. An ordnance venting system in a rocket warhead, comprising:

a first rocket section comprising a rocket warhead section having at least a first connectable end; and, an adapter for melting at high temperatures comprising a first mating surface and a second mating surface, the first mating surface of the adapter effective to rigidly connect to the first connectable end of the rocket warhead section and the second mating surface of the adapter effective to rigidly connect with a connectable end of a second rocket section comprising a fuze section, wherein the adapter comprises an external surface portion, and wherein the first mating surface and the second mating surface are non-continuous surfaces each in a different plane.

19. The ordnance venting system according to claim 18, wherein the external surface portion contacts the first connectable end and the second rocket fuze section.

20. The ordnance venting system according to claim 18, wherein the external surface portion is situated substantially intermediate the first connectable end and a portion of the second rocket fuze section.

* * * * *